US012808574B2

(12) United States Patent
Bae et al.

(10) Patent No.: US 12,808,574 B2
(45) Date of Patent: Nov. 24, 2026

(54) AIR HANDLING UNIT COMPRISING DRAIN COVER

(71) Applicant: LG ELECTRONICS INC., Seoul (KR)

(72) Inventors: Youngjoo Bae, Seoul (KR); Gangyoun Kim, Seoul (KR); Sung Min Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 250 days.

(21) Appl. No.: 18/782,247

(22) Filed: Jul. 24, 2024

(65) Prior Publication Data

US 2025/0102183 A1 Mar. 27, 2025

(30) Foreign Application Priority Data

Sep. 22, 2023 (KR) ..... 10-2023-0127409

(51) Int. Cl.

| | |
|---|---|
| ***F24F 13/22*** | (2006.01) |
| ***F24F 3/044*** | (2006.01) |
| ***F24F 13/20*** | (2006.01) |
| ***F24F 13/30*** | (2006.01) |

(52) U.S. Cl.

CPC ..... *F24F 13/222* (2013.01); *F24F 3/044* (2013.01); *F24F 13/20* (2013.01); *F24F 13/30* (2013.01)

(58) Field of Classification Search

CPC ..... F24F 13/222; F24F 13/30; F24F 3/044; F24F 1/0063; F24F 1/0073; F24F 2013/205; B01D 46/0006

See application file for complete search history.

(56) References Cited

U.S. PATENT DOCUMENTS

| | | | | |
|---|---|---|---|---|
| 5,715,697 | A * | 2/1998 | Rust, Jr. ..... | F24F 1/0073 62/286 |
| 11,506,406 | B2 | 11/2022 | Grabon | |
| 11,585,565 | B2 | 2/2023 | Stewart et al. | |
| 2007/0169499 | A1 * | 7/2007 | Rios ..... | F28F 17/005 62/286 |

FOREIGN PATENT DOCUMENTS

| | | | | |
|---|---|---|---|---|
| KR | 200146159 | Y1 * | 6/1999 | ..... F24F 1/36 |
| KR | 10-0518410 | | 6/2005 | |
| KR | 10-2007-0074407 | | 7/2007 | |

OTHER PUBLICATIONS

Korean Office Action issued in Application No. 10-2023-0127409 dated Feb. 12, 2025.

* cited by examiner

*Primary Examiner* — Emmanuel E Duke
(74) *Attorney, Agent, or Firm* — KED & ASSOCIATES

(57) ABSTRACT

An air handling unit is provided that may include a cabinet provided with an air inlet and an air outlet that are spaced from each other in a horizontal direction; a fan disposed between the air inlet and the air outlet and configured to discharge gas suctioned from the air inlet to the air outlet; at least one heat exchanger disposed between the air inlet and the fan and configured to exchange heat with gas suctioned from the air inlet; a first drain pan provided between the heat exchanger and the air inlet; and a second drain pan provided extending in the horizontal direction with respect to the at least one heat exchanger.

17 Claims, 9 Drawing Sheets

AIR HANDLING UNIT COMPRISING DRAIN COVER

CROSS-REFERENCE TO RELATED APPLICATION(S)

This application claims priority to and the benefit of Korean Patent Application No. 10-2023-0127409, filed in Korea on Sep. 22, 2023, the disclosure of which is incorporated herein by reference in its entirety.

BACKGROUND

1. Field

An air handling unit provided with a drain cover that collects condensed water is disclosed herein.

2. Background

Air handlers adjust a temperature and humidity of air in an indoor space or supply fresh air, and are usually used in a building or a vehicle, for example. An air handler ordinarily includes a heat exchanger that exchanges heat with air drawn into an air inlet, a fan that blows air drawn into the air inlet to an air outlet, for example, and operates based on a theory in which refrigerant compressed in a compressor release heat through a condenser and absorb heat through an evaporator, to cool or heat air in an indoor space. The air handler is also referred to as an air handling unit (AHU).

The air handling unit described above may be disposed in various places in various ways. For example, the air handling unit may directly suction air from an indoor space and discharge air to an indoor space. However, the air handling unit may be installed in an attic or a basement, or in an outdoor space, and suction air in a place in which the air handling unit is installed and supply air into an indoor space through a duct that communicates with the indoor space.

It may be useful to arbitrarily set a direction of the air inlet and the air outlet depending on a space in which the air handling unit is installed. Additionally, a cabinet constituting an exterior of the air handling unit is ordinarily provided with a service surface that is opened and closed for repairs and maintenance for example, and a panel that covers the service surface, and it may also be useful to arbitrarily set a direction of the service surface.

However, condensed water may form on a surface of a heat exchanger due to moisture included in air drawn into the air inlet, and accordingly, the air handling unit is ordinarily provided with a drain pan that collects and discharges falling condensed water. As collection of condensed water at the drain pan depends on gravity, the condensed water may not be drained properly in a case in which a direction in which the air handling unit is disposed changes arbitrarily.

In particular, in a case in which a flow path of air is formed horizontally, condensed water may fly or spray toward the air outlet due to wind formed by the fan. Thus, a problem in relation to dew condensation and moisture may occur at the fan, the air outlet, and the duct that communicates with the air outlet, for example.

BRIEF DESCRIPTION OF THE DRAWINGS

The embodiments will be described in detail with reference to the following drawings in which like reference numerals refer to like elements wherein.

DETAILED DESCRIPTION

Figure 1:
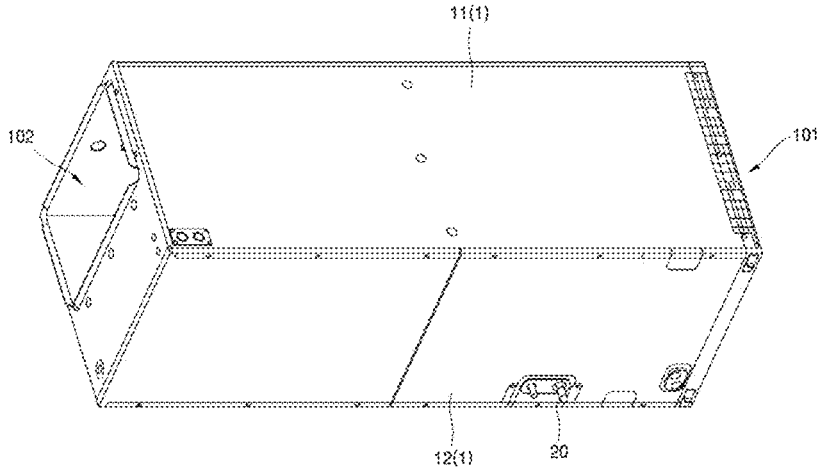
FIG. 1 is a perspective view of an exterior of an air handling unit according to an embodiment.

Aspects, features and advantages are specifically described hereinafter with reference to accompanying drawings such that one having ordinary skill in the art to which the subject matter pertains can embody the technical spirit easily. Herein, description of known technologies in relation to the subject matter is omitted if it is deemed to make the gist unnecessarily vague. Hereinafter, embodiments are specifically described with reference to the accompanying drawings. In the drawings, identical reference numerals denote identical or similar components.

The terms "first", "second" and the like are used herein only to distinguish one component from another component, but the components are not to be limited by the terms. Certainly, a first component can be a second component, unless stated to the contrary.

Herein, each component may be provided as a single one or a plurality of ones, unless explicitly indicated otherwise.

When any one component is described as being "in the upper portion (or the lower portion)" or "on (or under)" another component, any one component can be directly on (or under) another component, and an additional component can be interposed between the two components.

When any one component is described as being "connected", "coupled" or "connected" to another component, any one component can be directly connected or coupled to another component, but an additional component can be "interposed" between the two components, or the two components can be "connected", "coupled" or "connected" by an additional component.

Herein, singular forms include plural forms as well, unless explicitly indicated otherwise. The terms "being comprised of", "comprising", and the like do not imply necessarily including stated components or stated steps, and imply excluding some of the stated components or stated steps or including additional components or additional steps.

Throughout, the terms "A and/or B" as used herein can denote A, B or A and B, and the terms "C to D" can denote C or greater and D or less, unless stated to the contrary.

Hereinafter, embodiments are described with reference to the accompanying drawings.

An air handling unit according to an embodiment may be disposed in various directions and in various ways. Herein, a way of disposing an air outlet further upward than an air inlet is referred to a regular disposition, a way of disposing the air inlet further upward than the air outlet is referred to as a reverse disposition, and a way of spacing the air inlet and the air outlet from each other substantially horizontally is referred to as a horizontal disposition. Further, terms indicating directions are used in relation to the above-described ways of disposition, and unless the disposition state is limited, the terms indicating directions are used in a regular disposition state.

Figure 2:
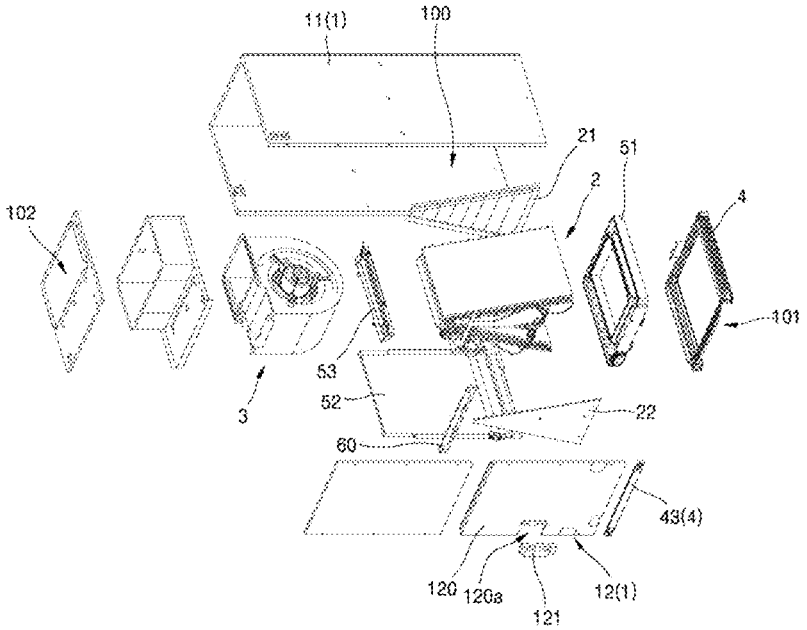
FIG. 2 is an exploded view of the air handling unit of FIG. 1.

Hereinafter, an air handling unit according to an embodiment is described in a state in which the air handling unit is disposed horizontally, with reference to FIGS. 1 and 2. FIG. 1 is a perspective view of an exterior of an air handling unit according to an embodiment. FIG. 2 is an exploded view of the air handling unit of FIG. 1. Referring to the drawings, the air handling unit according to an embodiment may include a cabinet 1 that is provided with an air inlet 101 and an air outlet 102 and defines an inner space 100 that accommodates a heat exchanger 2.

In a state in which the air handling unit according to an embodiment is disposed horizontally, the air inlet 101 and the air outlet 102 may be spaced from each other in a horizontal direction. In this orientation, a central longitudinal axis of the air handling unit extends in the horizontal direction. However, unless otherwise restricted hereinafter, the air inlet 101 and the air outlet 102 may be spaced from each other to the extent that the inner space 100 is disposed between the air inlet 101 and the air outlet 102.

The cabinet 1 may include a panel 12 that forms one or a first surface of the cabinet 1. The first surface may be a front surface of the cabinet 1. The panel 12 may be assembled to a main housing 11 a front of which is open, such that the cabinet 1 has a substantially rectangular cuboid shape. The panel 12 may be provided in such a way that the front surface of the cabinet 1 is opened and closed, such that repairs or maintenance, for example, may be performed inside of the air handling unit. However, the panel 12 may not necessarily constitute the front surface of the cabinet 1, and may not be necessarily opened and closed.

The air handling unit may include the heat exchanger 2 mounted in the inner space 100. The heat exchanger 2 may be provided to exchange heat with air suctioned into the inner space 100. The heat exchanger 2 may be configured to heat air for heating or to cool air for cooling.

A refrigerant pipe 20 may be connected to the heat exchanger 2. The refrigerant pipe 20 may be connected to an outdoor unit outside of the cabinet 1, to allow refrigerant having exchanged heat with an outdoor space to flow into the heat exchanger 2.

The air handling unit may include a fan 3. The fan 3 may be configured to discharge air having exchanged heat with the heat exchanger 2 to the air outlet 102. The fan 3 may be provided with a swiveling blade. A duct that blows air to an indoor space may communicate with the air outlet 102.

In a state in which the air handling unit according to an embodiment is disposed horizontally, the fan 3 may be disposed closer to the air outlet 102 than the heat exchanger 2. Accordingly, air suctioned into the air inlet 101 may exchange heat with the heat exchanger 2 and then be discharged by the fan 3 to the air outlet 102. However, unless otherwise restricted hereinafter, the heat exchanger 2 may be disposed between the air inlet 101 and the air outlet 102, and the fan 3 may be disposed anywhere including outside of the cabinet 1, as long as the fan 3 is disposed in a portion where there is a pressure difference between the air inlet 101 and the air outlet 102.

Hereinafter, structure of a filter bracket according to an embodiment is described with reference to FIGS. 2 and 3. Referring back to FIG. 2, a filter (not illustrated) may be disposed between the air inlet 101 and the heat exchanger 2. The filter may filter foreign substances from air suctioned into the inner space 100 from the air inlet 101.

The filter may be supported by a filter bracket 4. More specifically, the filter may be inserted into and installed in the filter bracket 4.

The filter bracket 4 may be fixed to the cabinet 1, between the air inlet 101 and the heat exchanger 2. Alternatively, in a state in which the air handling unit according to an embodiment is disposed regularly, that is, horizontally, the filter bracket 4 may be installed inside of a lower end portion of the cabinet 1 and define the air inlet 101.

Figure 3:
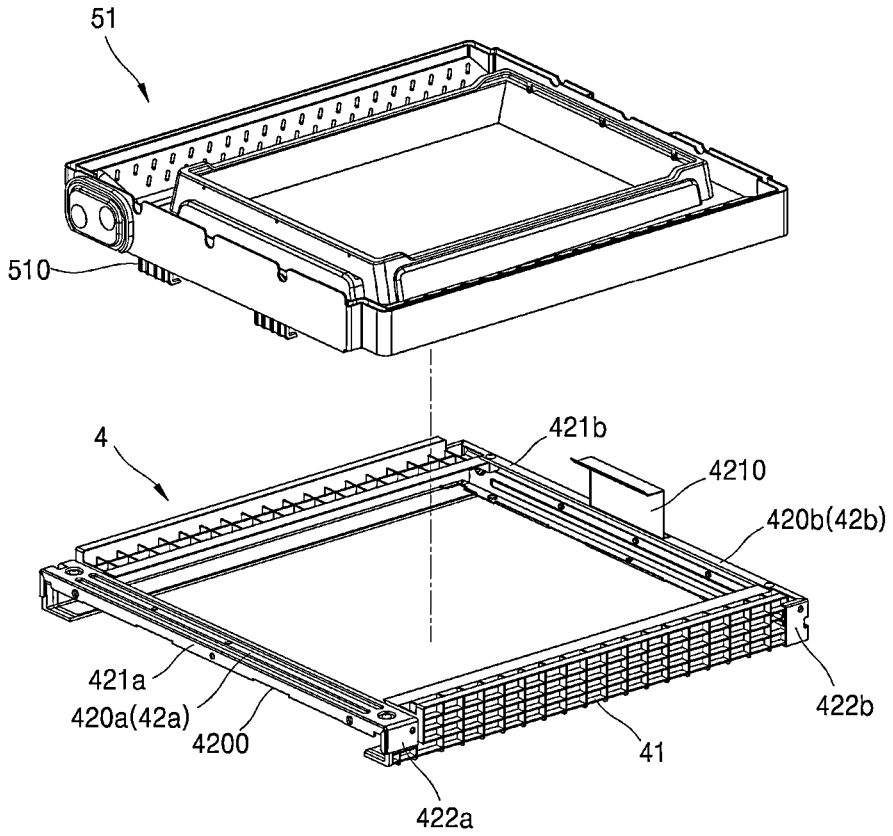
FIGS. 3 and 4 are perspective views of a first drain pan mounted in a filter bracket according to an embodiment.
Figure 4:
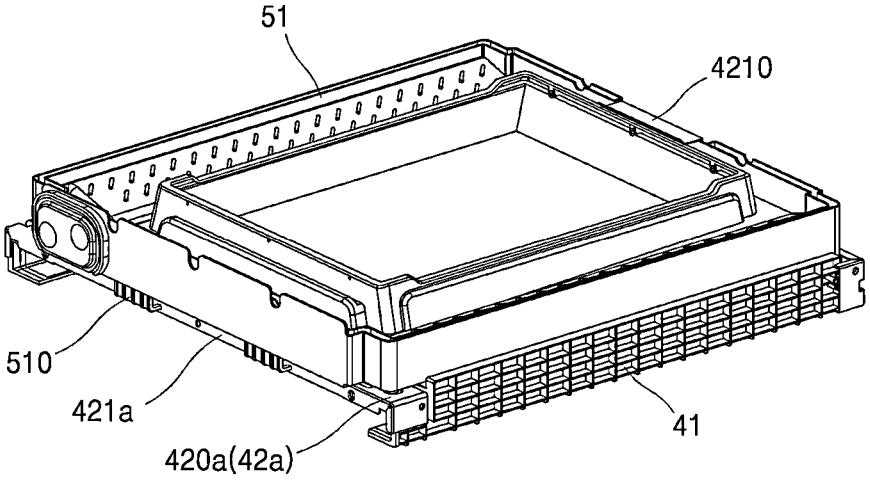

FIGS. 3 and 4 are views showing the structures of a drain pan according to an embodiment and a filter bracket according to an embodiment. Referring to the drawings, the filter bracket 4 may include a pair of rail members 41 and a pair of beams 42 that connects the rail members 41.

The rail member 41 may be provided with a rail 410 that extends in a frontward-rearward direction. The rail 410 may support end portions at a left or first side and a right or second side of the filter. More specifically, the rail 410 may accommodate the end portions at the first side and second side of the filter, respectively, in a shape in which the rail 410 is depressed from inner surfaces on a left or first and a right or second of the pair of rail members 41 toward outsides on a left or first side and a right or second side thereof. The filter may be inserted in the frontward-rearward direction along the rail 410 and mounted in the filter bracket 4.

The pair of beams 42 may include first beam 42*a* disposed at a front of the filter bracket 4 and second beam 42*b* disposed further rearward than the first beam 42*a*. The pair of beams 42 may have a same shape. Accordingly, parts of the filter bracket 4 may be shared, thereby ensuring economic efficiency in manufacturing.

The beam 42 may include a main support 420 that has a predetermined width and extends in a leftward-rightward direction. The filter bracket 4 may include a stiffness reinforcement part or portion 421 that extends from end portions at both sides of the main support 420 in a widthwise direction thereof, in a direction in both directions in which the main support 420 extends and a widthwise direction of the main support 420, and/or a side support 422 that extends from end portions at both sides of the main support 420 in the direction in which the main support 420 extends, in a direction the same as the direction in which the stiffness reinforcement portion 421 extends.

The beam 42 may be manufactured in such a way that both end portions of a sheet material of one metal, which has a predetermined width and extends, in the widthwise direction thereof and in a direction in which the sheet material extends, bend in the same direction, to form the main support 420, the stiffness reinforcement portion 421, and the side support 422.

Hereinafter, structure in which a first drain pan is disposed at the filter bracket according to an embodiment is described with reference to FIGS. 2 to 4.

Referring back to FIG. 2, the air handling unit according to an embodiment may include a first drain pan 51 that collects condensed water that is formed on a surface of the heat exchanger 2 and falls from the heat exchanger 2. In a state in which the air handling unit according to an embodiment is disposed regularly, that is, horizontally, the first drain pan 51 may be disposed between the heat exchanger 2 and the air inlet 101, and collect condensed water falling downward from the heat exchanger 2.

In a state in which the air handling unit according to an embodiment is disposed regularly, that is, horizontally, the heat exchanger 2 may be supported by the filter bracket 4. The first drain pan 51 may be disposed above or in an upward direction with respect to the filter bracket 4 and may directly support the heat exchanger 2.

Figure 6:
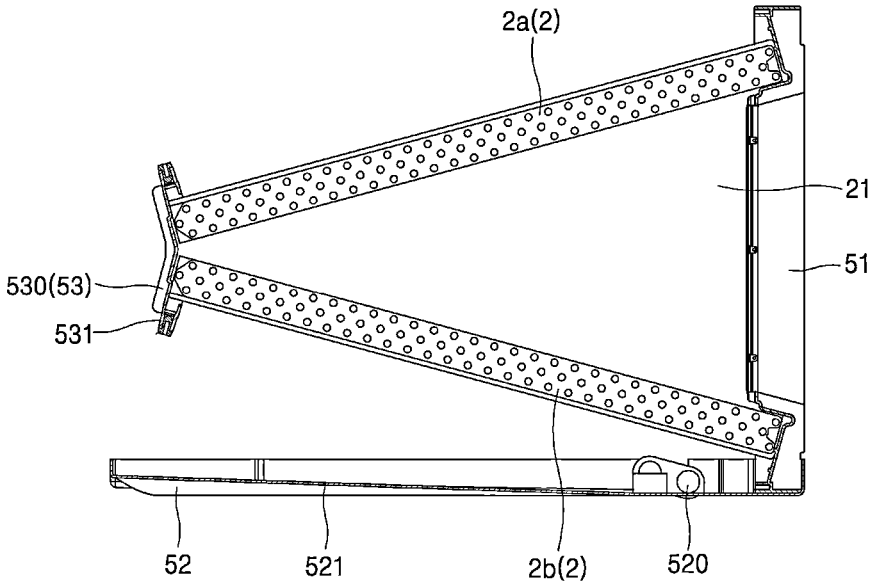
FIG. 6 is a cross-sectional view of a heat exchanger, a drain pan, and a drain cover in a state in which the air handling unit according to an embodiment is disposed horizontally.
Figure 7:
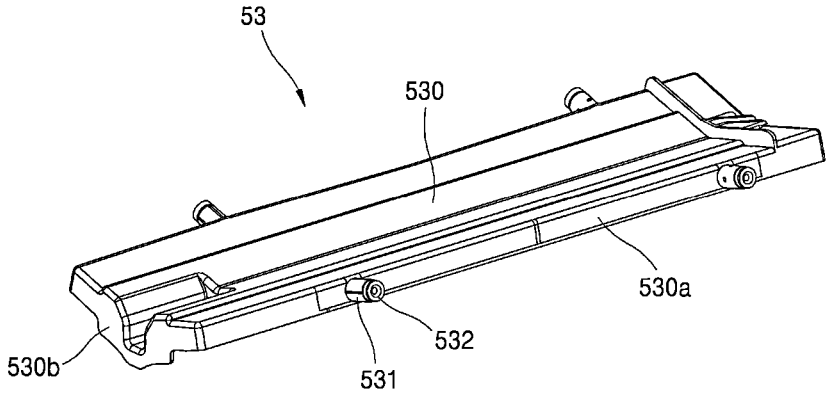
FIG. 7 is a view of a drain cover according to an embodiment.

FIGS. 6 and 7 are views showing structure in which the first drain pan according to an embodiment is mounted in the filter bracket. Referring to the drawings, the first drain pan 51 may be disposed on the main support 420*a* of the first beam 42*a* and the pair of rail members 41.

The first drain pan 51 may have an escape prevention hook 510 at a front end portion thereof. The escape prevention hook 510 may extend toward the filter bracket 4, and its end portion may protrude rearward. The first beam 42*a* may be provided with a hook accommodation part or portion 4200 into which the escape prevention hook 510 may be inserted and which interferes with the escape prevention hook 510 in the upward-downward direction. More specifically, the hook accommodation portion 4200 may have a shape in which the hook accommodation portion 4200 is indented inward from the end portion of the stiffness reinforcement portion 421*a* of the first beam 42*a*. Accordingly, the front end portion of the first drain pan 51 may be prevented from escaping upward from the filter bracket 4.

The second beam 42*b* may connect with an escape prevention plate 4210 that extends toward the first drain pan 51 and interferes with an upper surface of the first drain pan 51. More specifically, the escape prevention plate 4210 may prevent a rear end portion of the first drain pan 51 from escaping upward.

The first drain pan 51 may be mounted in the filter bracket 4 while the first drain pan 51 slides rearward at a position above a position of the filter bracket 4. The first drain pan 51 may be fixed by the hook accommodation portion 4200 and the escape prevention plate 4210, such that the front and rear end portions of the first drain pan 51 may not escape upward. After the first drain pan 51 is mounted in the filter bracket 4, the panel 12 may be assembled to a front of the first drain pan 51, and may prevent the first drain pan 51 from escaping forward from the filter bracket 4. That is, in the air handling unit according to an embodiment, the first drain pan 51 may be fixed so as not to escape from the filter bracket 4 in any direction.

Hereinafter, structure of a second drain pan according to an embodiment is described with reference to FIGS. 5 and 6.

Figure 5:
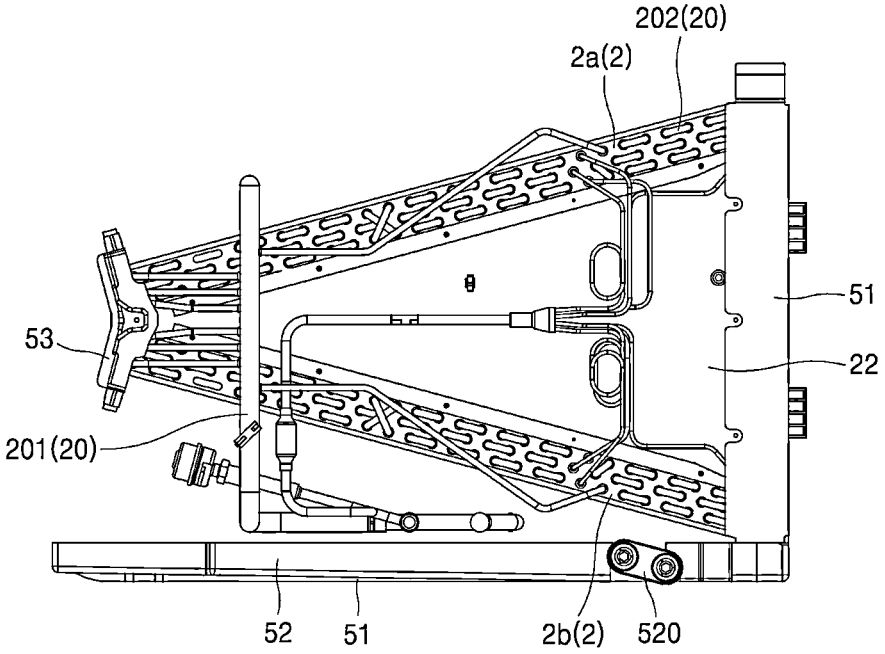
FIG. 5 is a perspective view of front surfaces of a heat exchanger, a drain pan, and a drain cover in a state in which the air handling unit according to an embodiment is disposed horizontally.

FIG. 5 is a view showing front surfaces of a heat exchanger, a drain pan, and a drain cover in a state in which the air handling unit according to an embodiment is disposed horizontally. FIG. 6 is a cross-sectional view of a heat exchanger, a drain pan, and a drain cover in a state where the air handling unit according to an embodiment is disposed horizontally. Referring to the drawings, the air handling unit may include a second drain pan 52. In a case in which the air handling unit is disposed horizontally, the second drain pan 52 may collect and discharge condensed water formed at the heat exchanger 2 and falling from the heat exchanger 2.

The air handling unit may be provided with the first drain pan 51 and the second drain pan 52 that respectively extend in a direction across a direction parallel with a direction in which air flows from the air inlet 101 to the air outlet 102 and in a direction parallel with a direction parallel with a direction in which air flows from the air inlet 101 to the air outlet 102, such that the second drain pan 52 collects and drains condensed water that is formed at the heat exchanger 2 and falls down from the heat exchanger 2. Thus, the air handling unit may be disposed vertically or the air handling unit may be disposed horizontally.

The second drain pan 52 may be provided to extend in a direction in which the air inlet 101 and the air outlet 102 are spaced from each other with respect to the heat exchanger 2. In a state in which the air handling unit according to an embodiment is disposed horizontally, the air inlet 101 and the air outlet 102 may be spaced from each other in the horizontal direction, that is, the frontward-rearward direction, and the second drain pan 52 may be disposed below in a downward direction with respect to the heat exchanger 2.

Hereinafter, terms indicating a direction, such as a vertical direction, and a horizontal direction, for example, are used with reference to a horizontally disposed state in which the air outlet 102 and the air inlet 101 are spaced from each other in the horizontal direction.

The second drain pan 52 may be provided with an inclined surface 521, a height of which decreases from the air outlet 102 toward the air inlet 101. Accordingly, condensed water falling to the second drain pan 52 may flow down to the air inlet 101 along the inclined surface 521. A drain outlet 520 that discharges condensed water having fallen to the second drain pan 52 outward may be provided at an end portion at an air inlet side of the second drain pan 52.

In a modified embodiment, the inclined surface may be formed in such a way that a height of the inclined surface decreases from the air inlet toward the air outlet. Condensed water collected in the second drain pan may flow down to the air outlet along the inclined surface. The drain outlet may be provided at the end portion at an air outlet side of the second drain pan.

The end portion at the air outlet side of the heat exchanger 2 may be covered by a drain cover 53 that collects condensed water formed at the heat exchanger 2 and drains the condensed water to the second drain pan 52. The second drain pan 52 may extend toward the air outlet, at least up to under the drain cover 53. More specifically, the second drain pan 52 may extend toward the air outlet at least up to under a drain hole 531 described hereinafter.

Condensed water collected at the drain cover 53 may fall to the second drain pan 52 extended at least up to under the drain cover 53, flow down toward the air inlet along the inclined surface 521, and be discharged to the drain outlet 520.

Hereinafter, structure of a drain cover according to an embodiment is described with reference to FIGS. 5 to 7.

Hereinafter, terms indicating a direction, such as a vertical direction, and a horizontal direction, for example, are used with reference to a horizontally disposed state in which the air outlet 102 and the air inlet 101 are spaced from each other in the horizontal direction.

Referring to FIG. 7 and referring back to FIGS. 5 and 6, in a state in which the air handling unit according to an embodiment is disposed horizontally, the drain cover 53 may include a drain part or portion 530 that extends at least vertically. As the drain portion 530 extends vertically, the drain cover 53 may collect condensed water that flies or sprays toward the air outlet from the heat exchanger 2 in a large range, and also collect condensed water that flies or sprays while falling because of the effect of gravity.

The drain portion 530 may protrude and extend further in at least any one of the upward direction and the downward direction than the end portion at the air outlet side of the heat exchanger 2. Condensed water that is formed at the heat exchanger 2 and slides up to the end portion at the air outlet side of the heat exchanger 2 along the surface of the heat exchanger 2 may drift and move toward the air outlet, under the influence of gravity, and the drain portion 530 may protrude and extend further in at least any one of the upward direction and the downward direction than the end portion at the air outlet side of the heat exchanger 2, to ensure a better collection of condensed water.

In a case in which the drain portion 530 protrudes and extends further downward than the end portion at the air outlet side of the heat exchanger 2, the drain hole 531 that is open downward may be provided at a lower end portion of the drain portion 530. Condensed water collected at the drain portion 530 may flow down along an inner surface of the drain portion 530 and be drained through the drain hole 531.

The condensed water falling through the drain hole 531 may fall and gather at the second drain pan 52. The second drain pan 52 may extend at least up to under the drain hole 531, toward the air outlet.

The drain 530 may protrude and extend further upward and downward than the end potion of the air outlet side of the heat exchanger 2. The drain hole 531, which may be open in the upward-downward direction may be provided, respectively, at an upper end portion and a lower end portion of the drain 530. As the drain 530 extends in the upward and downward direction, the air handling unit may be disposed horizontally in two directions that are symmetrical to each other in the upward-downward direction, and the drain hole 531 may be provided at both the upper end portion and the lower end portion of the drain 530.

In the case in which the drain hole 531 is provided in both the upper end portion and the lower end portion of the drain 530, the drain hole 531 provided in the upper end portion of the drain 530 may be selectively sealed by a drain hole cap 532. Accordingly, discharge of condensed water collected at the drain 530 in the upward direction of the drain cover 53 and flying or spraying of the condensed water toward the air outlet, caused by wind pressure, may be prevented. The drain hole cap 532 may only seal a drain hole facing upward out of the drain holes 531, based on a direction where the air handling unit is disposed horizontally.

The drain cover 53 may include a first side wall 530*a* that protrudes toward the air inlet, on at least any one of the upper end portion and the lower end portion of the drain 530. As the first side wall 530*a* is provided, condensed water collected at the drain 530 may fall to the second drain pan 52 without flying or spraying toward the air outlet from the upper and lower end portions of the drain 530. In particular, in the case in which the drain hole 531 is provided at the drain cover 53, condensed water collected at the drain 530 may flow into the drain hole 531 along the first side wall 530*a*.

The drain cover 53 may include a second side wall 530*b* that protrudes toward the air inlet, on at least any one of the front end portion or the rear end portion of the drain 530. Accordingly, condensed water collected at the drain 530 may directly fall to the second drain pan 3 or flow into the drain hole 531 without flying or spraying toward the air outlet from the front and rear end portions of the drain 530.

The second side wall 530*b* may be fixed to at least one of a front surface or a rear surface of the heat exchanger 2. As the drain cover 53 is fixed to the heat exchanger 2, movement and deformation of the drain cover 53, caused by wind pressure generated by the fan, may be prevented. Additionally, the drain cover 53 may connect to the heat exchanger 2 forward and rearward such that a flow of air passing in the upward and downward directions of the heat exchanger 2 is not prevented.

Hereinafter, disposition of a drain cover and a heat exchanger according to an embodiment is described with reference to FIGS. 5 and 6. Referring back to FIGS. 5 and 6, the drain 530 may be spaced a predetermined distance apart from the end portion at the air outlet side of the heat exchanger 2 in the horizontal direction. As the drain 530 is spaced a predetermined distance apart from the heat exchanger 2, a path through which air flows toward the fan 3 past the heat exchanger 2 may be ensured. Additionally, as a flow of air passing the end portion at the air outlet side of the heat exchanger 2, covered by the drain 530, is generated, condensed water is more likely to be collected at the drain 530.

The heat exchanger 2 may include a first heat exchanger 2*a* and a second heat exchanger 2*b* that are spaced from each other in the upward-downward direction. A distance between an end portion at an air outlet side of the first heat exchanger 2*a* and an end portion at an air outlet side of the second heat exchanger 2*b* may be less than a distance between an end portion at an air inlet side of the first heat exchanger 2*a* and an end portion at an air inlet side of the second heat exchanger 2*b*. Accordingly, the heat exchanger 2 may contact air drawn through the air inlet 101 on a larger surface area, for a longer period, to ensure efficient heat exchange, and may guide an air flow into a space between the first heat exchanger 2*a* and the second heat exchanger 2*b*. Thus, the condensed water may also be induced to gather at the drain cover 53 along the air flow.

The drain cover 53 may cover the end portion at the air outlet side of the first heat exchanger 2*a* and the end portion at the air outlet side of the second heat exchanger 2*b*, at the same time. Condensed water may be induced along air flowing along the inner surfaces and the outer surfaces of the first heat exchanger 2*a* and the second heat exchanger 2*b* and collected at the drain cover 53.

A predetermine gap may be formed between the end portions at the air outlet sides of the first heat exchanger 2*a* and the second heat exchanger 2*b* in the upward-downward direction, and the drain cover 53 may cover the gap between the first heat exchanger 2*a* and the second heat exchanger 2*b*. Accordingly, air drawn between the first heat exchanger 2*a* and the second heat exchanger 2*b* may flow between the end portions at the air outlet side of the first heat exchanger 2*a* and the second heat exchanger 2*b*, covered by the drain cover 53, and condensed water may also gather at the drain cover 53.

Hereinafter, structures of a front cover and a rear cover according to an embodiment, and a structure in which a drain cover protrudes forward are described with reference to FIGS. 8 and 9.

Figure 8:
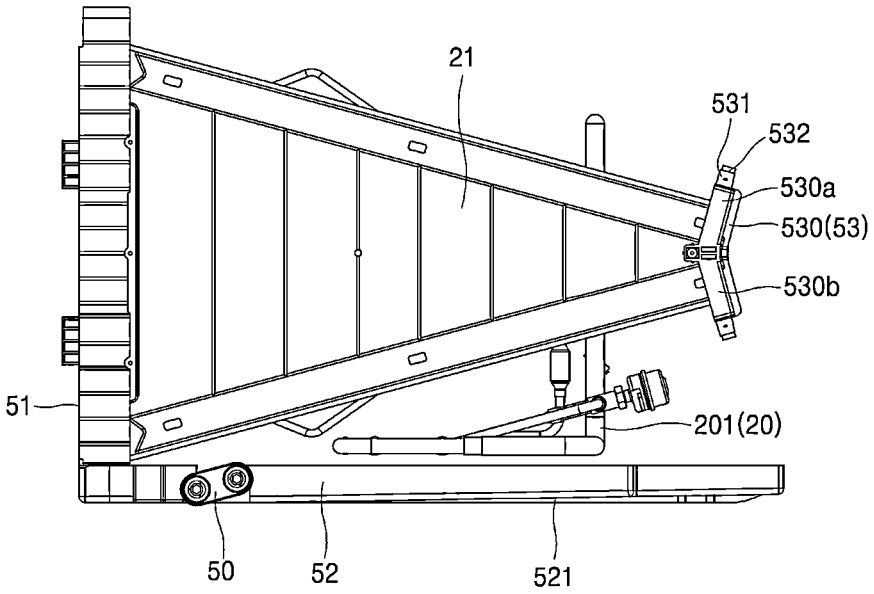
FIG. 8 is a perspective view of rear surfaces of a heat exchanger, a drain pan, and a drain cover in a state in which the air handling unit according to an embodiment is disposed horizontally.

FIG. 8 shows rear surfaces of heat exchanger 2, drain pan 3, and drain cover 53 in a state in which the air handling unit according to an embodiment is disposed horizontally. Referring to the drawing, the air handling unit may include a rear cover 21 that covers a rear of the heat exchanger 2. As the rear of the heat exchanger 2 is covered by the rear cover 21, air contacting the heat exchanger 2 may flow toward the air outlet without escaping rearward, and condensed water formed at the heat exchanger 2 may directly fall to the second drain pan 52, or gather at the drain cover 53 provided at the air outlet side of the heat exchanger 2 without escaping rearward.

Figure 9:
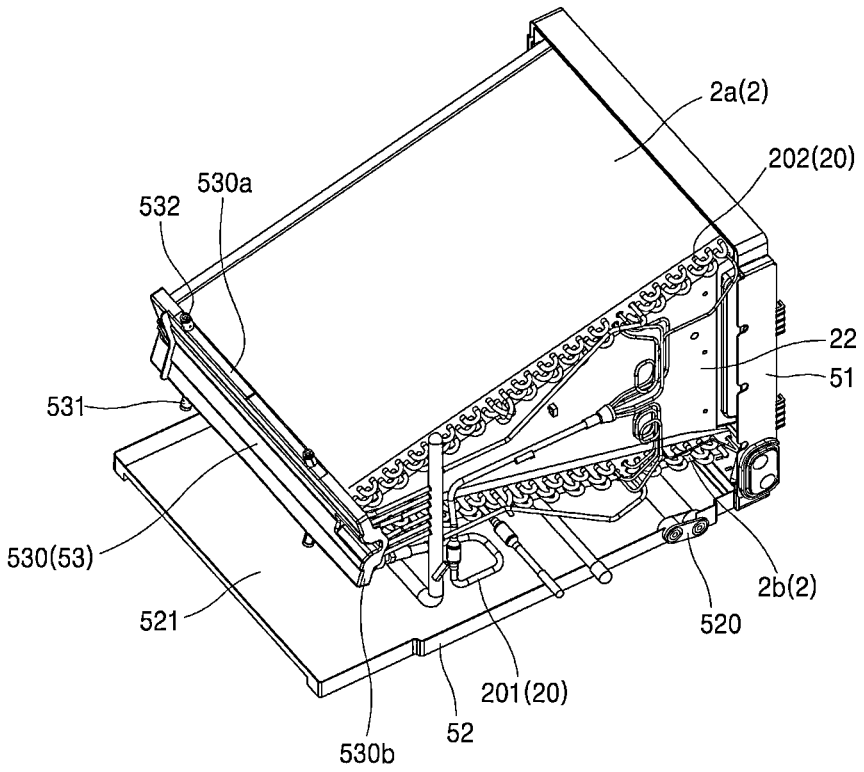
FIG. 9 is a perspective view of a heat exchanger, a drain pan, and a drain cover in a state in which the air handling unit according to an embodiment is disposed horizontally.

FIG. 9 shows structures of heat exchanger 2, drain pan 3, and a drain cover 53 in a state in which the air handling unit according to an embodiment is disposed horizontally. Referring to the drawing, heat exchanger 2 may include outer refrigerant pipe 201 that connects to a front of the heat exchanger 2, and a front cover 22 that covers a front of a space between the first heat exchanger 2*a* and the second heat exchanger 2*b*. As the front cover 22 covers the front of the space between the first heat exchanger 2*a* and the second heat exchanger 2*b*, air drawn between the first heat exchanger 2*a* and the second heat exchanger 2*b* may not escape forward, and condensed water formed on the inner surface of the heat exchanger 2 may directly fall to the second drain pan 52, or gather at the drain cover 53 provided at the air outlet side of the heat exchanger 2, without escaping forward.

The front end portion of the drain 530 may protrude and extend further forward than the heat exchanger 2. The front end portion of the drain 530 may collect condensed water formed at the outer refrigerant pipe 201 that connects to the front of the heat exchanger 2 and drain the condensed water to the second drain pan 52.

Embodiments disclosed herein provide a structure of an air handling unit, in which the air handling unit is selectively disposed vertically such that an air inlet and an air outlet are spaced from each other vertically, or selectively disposed horizontally such that the air inlet and the air outlet are spaced from each other horizontally. More specifically, embodiments disclosed herein provide an air handling unit in which condensed water is drained in both a vertically disposed state and a horizontally disposed state.

Embodiments disclosed herein provide an air handling unit, in which condensed water that is formed at a heat exchanger and flies or sprays toward an air outlet along wind is collected and drained in a state in which the air handling unit is disposed horizontally.

Embodiments disclosed herein provide an air handling unit, in which a specific direction in which the air handling unit is disposed is selected out of two or more directions.

Advantages are not limited to the above advantages, and other advantages that are not mentioned above may be clearly understood from the following description and may be more clearly understood from the embodiments set forth herein. Additionally, the advantages may be realized via means and combinations thereof that are described in the appended claims.

Embodiments disclosed herein provide an air handling unit (first structure) that may include a cabinet provided with an air inlet and an air outlet that are spaced from each other in one direction across a frontward-rearward direction; a fan disposed between the air inlet and the air outlet and configured to discharge gas suctioned from the air inlet to the air outlet; a heat exchanger disposed between the air inlet and the fan and configured to exchange heat with gas suctioned from the air inlet; a first drain pan provided between the heat exchanger and the air inlet; and a second drain pan provided in a direction across the one direction with respect to the heat exchanger. The air handling unit may be provided with a first drain pan and a second drain pan that respectively extend in a direction across the one direction parallel with a direction in which air flows from the air inlet to the air outlet, and in a direction parallel with the one direction parallel with a direction in which air flows from the air inlet to the air outlet, such that the air handling unit collects and drains condensed water that is formed at the heat exchanger and falls downward, in both cases in which the air handling unit is disposed vertically and horizontally.

The air handling unit may include a drain cover installed to cover an end portion at an air outlet side of the heat exchanger and to collect condensed water formed at the heat exchanger. More specifically, the drain cover may extend in a direction across the one direction. In particular, as the direction in which air flows is across the gravitational direction in the case in which the air handling unit is disposed horizontally, condensed water is highly likely to flow toward the air outlet because of wind, making it possible to collect the condensed water at the drain cover effectively.

Embodiments disclosed herein provide an air handling unit (second structure) that may include a cabinet provided with an air inlet and an air outlet that are spaced from each other in one horizontal direction across a frontward-rearward direction; a fan disposed between the air inlet and the air outlet and configured to discharge gas suctioned from the air inlet to the air outlet; a heat exchanger disposed between the air inlet and the fan and configured to exchange heat with gas suctioned from the air inlet; a second drain pan provided in a downward direction of the heat exchanger; and a drain cover extended in a direction across the one horizontal direction, and installed to cover an end portion at an air outlet side of the heat exchanger and to collect condensed water formed at the heat exchanger.

Hereinafter, technical solutions commonly applicable to the first structure and the second structure are described specifically. Hereinafter, terms indicating a vertical direction and a horizontal direction, for example, are used in a horizontally disposed state in which the air outlet and the air inlet are spaced from each other in one horizontal direction. The second drain pan may be disposed downward with respect to the heat exchanger.

The drain cover may include a drain part (drain) that extends at least vertically. Accordingly, even in a case in which condensed water flying or spraying toward the air outlet from the heat exchanger falls because of gravity, the drain cover may collect the condensed water.

The drain part may protrude and extend further in at least any one of an upward direction and a lower direction than the end portion at the air outlet side of the heat exchanger. Condensed water generated from the heat exchanger may slide up to the end portion at the air outlet side of the heat exchanger along the surfaces of the upper and lower sides of the heat exchanger, and then may drift toward the air outlet, under the influence of gravity, such that the drain part protrudes and extends further vertically than the end portion at the air outlet side of the heat exchanger, making it possible to collect the condensed water at the drain cover effectively.

The drain part may protrude and extend further downward than the end portion at the air outlet side of the heat exchanger. The drain part may have a drain hole open downward, in a lower end portion thereof. Condensed water collected at the drain part may flow along an inner surface of the drain part and be drained through the drain hole.

The drain part may protrude and extend further upward and downward than the end portion at the air outlet side of the heat exchanger. A drain hole open upward and downward may be provided in an upper end portion and a lower end portion of the drain part. The drain part protrudes and extends further upward and downward than the end portion at the air outlet side of the heat exchanger, such that the air handling unit is disposed horizontally in two directions that are symmetrical to each other in an upward-downward direction.

The drain hole provided in the upper end portion of the drain part may be sealed by a drain hole cap. Accordingly, condensed water collected at the drain part may be prevented from being discharged in an upper direction of the drain cover because of wind pressure.

The second drain pan may extend at least up to under the drain hole, toward the air outlet. Accordingly, condensed water gathering at the drain part and flowing out through the drain hole may fall and gather at the second drain pan.

The second drain pan may be provided with an inclination or inclined surface a height of which decreases from the air outlet side toward an air inlet. Accordingly, condensed water having fallen to the second drain pan may flow toward the air inlet along the inclination surface. In particular, as the drain hole is disposed at a position corresponding to the air outlet side of the second drain pan, the inclination surface is provided such that condensed water having fallen from the drain hole flows down toward the air inlet. A drain outlet may be provided in the end portion at the air inlet side of the second drain pan and discharge condensed water having fallen to the second drain pan outward.

Unlike the above inclination surface, an inclination surface may have a height that decreases from the air inlet side toward the air outlet. Condensed water collected at the second drain pan may flow down toward the air outlet along the inclination surface. The drain outlet may be provided in the end portion at the air outlet side of the second drain pan.

The drain part may be spaced a predetermined distance apart from the end portion at the air outlet side of the heat exchanger in the one horizontal direction. As the drain part is spaced a predetermined distance apart from the heat exchanger, a path in or through which air flows toward the fan past the heat exchanger may be ensured. Additionally, as a flow of air passing the end portion at the air outlet side of the heat exchanger, covered by the drain part, is generated, condensed water is more likely to gather at the drain part.

The drain cover may include a first side wall part (side wall) configured to protrude toward the air inlet, on at least any one of an upper end portion or a lower end portion of the drain part. As the first side wall part is provided, condensed water collected at the drain part may fall to the second drain pan without flying or spraying toward the air outlet from the upper end portion and the lower end portion of the drain part. In particular, in the case in which the drain hole is provided at the drain cover, condensed water collected at the drain part may flow into the drain hole along the first side wall part.

The drain cover may include a second side wall part (side wall) configured to protrude toward the air inlet, on at least any one of a front end portion or a rear end portion of the drain part. Accordingly, condensed water collected at the drain part may directly fall to the second drain pan or flow into the drain hole without flying or spraying toward the air outlet from the front end portion and the lower end portion of the drain part.

The second side wall part may be fixed to at least one of a front surface or a rear surface of the heat exchanger. The drain cover may be fixed to the heat exchanger such that movement and deformation of the drain cover, caused by wind pressure generated by the fan, is prevented. Additionally, the drain cover may connect to the heat exchanger forward and rearward, such that the drain cover does not interfere with a flow of air passing in the upward and downward directions of the heat exchanger.

The heat exchanger may include a first heat exchanger and a second heat exchanger spaced from each other in an upward-downward direction. A distance between an end portion at an air outlet side of the first heat exchanger and an end portion at an air outlet side of the second heat exchanger may be less than a distance between an end portion at an air inlet side of the first heat exchanger and an end portion at an air inlet side of the second heat exchanger. Accordingly, the heat exchanger may exchange heat efficiently with air drawn through the air inlet while contacting the air on a greater surface area, and guide a flow of air into a space between the first heat exchanger and the second heat exchanger. Thus, the condensed water may also be induced to gather at the drain cover along the flow of air.

The drain cover may cover the end portion at the air outlet side of the first heat exchanger and the end portion at the air outlet side of the second heat exchanger at the same time. Condensed water may be induced along air flowing along inner surfaces and outer surfaces of the first heat exchanger and the second heat exchanger, and collected at the drain cover.

The air handling unit may include a rear cover configured to cover a rear of the heat exchanger. As the rear cover covers the rear of the heat exchanger, that air contacting the heat exchanger may flow toward the air outlet without escaping air contacting the heat exchanger rearward, and condensed water formed at the heat exchanger may directly fall to the second drain pan, or gather at the drain cover provided at the air outlet side of the heat exchanger, without escaping rearward.

The heat exchanger may include an outer refrigerant pipe configured to connect to a front of the heat exchanger; and a front cover configured to cover a front of a space between the first heat exchanger and the second heat exchanger. As the front cover may cover the front of the space between the first heat exchanger and the second heat exchanger, air drawn between the first heat exchanger and the second heat exchanger may not escape forward, and condensed water formed on the inner surface of the heat exchanger may directly fall to the second drain pan or gather at the drain coved provided at the air outlet side of the heat exchanger without escaping forward.

A front end portion of the drain part may protrude and extend further forward than the heat exchanger. The protruding front end portion of the drain part may collect condensed water formed at the outer refrigerant pipe connected to the front of the heat exchanger and may drain the condensed water to the second drain pan.

A predetermined gap may be formed between the end portions at the air outlet sides of the first heat exchanger and the second heat exchanger in an upward-downward direction, and the drain cover may cover the gap between the first heat exchanger and the second heat exchanger. Accordingly, air drawn between the first heat exchanger and the second heat exchanger may flow between the end portions at the air outlet sides of the first heat exchanger and the second heat exchanger, covered by the drain cover, and accordingly, condensed water may gather at the drain cover.

Embodiments disclosed herein provide an air handling unit, in which a first drain pan and a second drain pan are provided such that a drain structure is provided in both a case in which the air handling unit is disposed vertically and horizontally.

Embodiments disclosed herein further provide an air handling unit, in which condensed water that is formed at a heat exchanger and flies or sprays toward an air outlet along wind is collected and drained by a drain cover extending to cover an end portion at the air outlet side of the heat exchanger, in a state in which the air handling unit is disposed horizontally.

Embodiments disclosed herein furthermore provide air handling unit, in which a direction in which a drain hole is open is selected, such that the air handling unit is disposed horizontally in two or more specific directions.

Embodiments disclosed herein also provide a drain pan and/or a drain cover that may efficiently collect and drain condensed water formed at a heat exchanger and a refrigerant pipe provided at the heat exchanger.

In all aspects, the embodiments are provided as examples, and embodiments are not limited to the embodiments set forth herein, and the scope is defined only according to the appended claims rather than the above description. Further, the meaning and scope of the claims described hereinafter, and all the modifications and modifiable embodiments drawn therefrom and drawn from equivalents thereof are to be included in the scope of the present disclosure.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiment.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air handling unit, comprising:

a cabinet provided with an air inlet and an air outlet that are spaced from each other in a horizontal direction;

a fan that is disposed between the air inlet and the air outlet and suctions air from the air inlet to the air outlet;

at least one heat exchanger disposed between the air inlet and the fan and that exchanges heat with the air suctioned from the air inlet;

at least one drain pan, the at least one drain pan being disposed under the at least one heat exchanger; and a drain cover that extends in a direction perpendicular to the horizontal direction, installed to cover an end portion at an air outlet side of the at least one heat exchanger and configured to collect condensed water formed at the at least one heat exchanger, wherein the drain cover comprises a drain portion that extends at least vertically, wherein the drain portion protrudes and extends further in at least any one of an upward direction or a downward direction than the end portion at the air outlet side of the at least one heat exchanger, wherein the drain portion protrudes and extends further in the downward direction than the end portion at the air outlet side of the at least one heat exchanger, and wherein a drain hole open in the downward direction is provided at a lower end portion of the drain portion.

2. The air handling unit of claim 1, wherein the drain portion protrudes and extends further in the upward direction and in the downward direction than the end portion at the air outlet side of the heat exchanger, wherein a drain hole is provided at an upper end portion and the lower end portion of the drain portion, respectively, and is open the upward direction and the downward direction, respectively, and wherein the drain hole provided in the upper end portion of the drain portion is sealed by a drain hole cap.

3. The air handling unit of claim 2, wherein the at least one drain pan is provided with an inclined surface a height of which decreases from the air outlet side toward the air inlet, and wherein a drain outlet is provided at an end portion at the air inlet side of the at least one drain pan and discharges condensed water having fallen to the at least one drain pan outward.

4. The air handling unit of claim 1, wherein the at least one drain pan extends towards the air outlet at least up to under the drain hole.

5. The air handling unit of claim 1, wherein the at least one drain pan is spaced a predetermined distance apart from the end portion at the air outlet side of the at least one heat exchanger in the horizontal direction.

6. The air handling unit of claim 1, wherein the drain cover comprises a first side wall that protrudes toward the air inlet, on at least any one of an upper end portion or a lower end portion of the drain portion.

7. The air handling unit of claim 6, wherein the drain cover comprises a second side wall configured to protrude toward the air inlet, on at least any one of a front end portion or a rear end portion of the drain portion.

8. The air handling unit of claim 7, wherein the second side wall is fixed to at least one of a front surface or a rear surface of the at least one heat exchanger.

9. The air handling unit of claim 1, wherein the at least one heat exchanger comprises a first heat exchanger and a second exchanger spaced from each other in an upward-downward direction, and wherein a distance between an end portion at an air outlet side of the first heat exchanger and an end portion at an air outlet side of the second heat exchanger is less than a distance between an end portion at an air inlet side of the first heat exchanger and an end portion at an air inlet side of the second heat exchanger.

10. The air handling unit of claim 9, wherein the drain cover covers both of the end portion at the air outlet side of the first heat exchanger and the end portion at the air outlet side of the second heat exchanger.

11. The air handling unit of claim 9, wherein the air handling unit further comprises a rear cover configured to cover a rear of the first and second heat exchangers.

12. The air handling unit of claim 11, further comprising:

an outer refrigerant pipe configured to connect to a front of the first and second heat exchangers; and a front cover configured to cover a front of a space between the first heat exchanger and the second heat exchanger.

13. The air handling unit of claim 12, wherein a predetermine gap is formed between the end portions at the air outlet sides of the first heat exchanger and the second heat exchanger in the upward-downward direction, and wherein the drain cover covers the predetermined gap between the first heat exchanger and the second heat exchanger.

14. The air handing unit of claim 12, wherein the drain cover comprises a drain portion that extends at least vertically, and wherein a front end portion of the drain portion protrudes and extends further forward than the first and second heat exchangers.

15. An air handling unit, comprising:

a cabinet provided with an air inlet and an air outlet that are spaced from each other in a first direction;

a fan that is disposed between the air inlet and the air outlet and creates a flow of air from the air inlet to the air outlet;

at least one heat exchanger disposed between the air inlet and the fan and that exchanges heat with the air;

at least one drain pan, the at least one drain pan being disposed under the at least one heat exchanger; and a drain cover that extends in a second direction perpendicular to the first direction, installed to cover an end portion at an air outlet side of the at least one heat exchanger and configured to collect condensed water formed at the at least one heat exchanger, wherein the drain cover comprises a drain portion that extends at least in the second direction, wherein the drain portion protrudes and extends further in the second direction than the end portion at the air outlet side of the at least one heat exchanger, and wherein a drain hole open in the second direction is provided at the end portion of the drain portion.

16. The air handling unit of claim 15, wherein the at least one heat exchanger comprises a first heat exchanger and a second exchanger spaced from each other in the second direction, and wherein a distance between an end portion at an air outlet side of the first heat exchanger and an end portion at an air outlet side of the second heat exchanger is less than a distance between an end portion at an air inlet side of the first heat exchanger and an end portion at an air inlet side of the second heat exchanger.

17. The air handling unit of claim 16, wherein the drain cover covers both of the end portion at the air outlet side of the first heat exchanger and the end portion at the air outlet side of the second heat exchanger.

* * * * *